US011629680B2

(12) United States Patent
Lyle

(10) Patent No.: US 11,629,680 B2
(45) Date of Patent: Apr. 18, 2023

(54) TESTING APPARATUS FOR A FUEL INJECTOR

(71) Applicant: DELPHI TECHNOLOGIES IP LIMITED, St. Michael (BB)

(72) Inventor: Anthony P. Lyle, Bicester (GB)

(73) Assignee: DELPHI TECHNOLOGIES IP LIMITED, St. Michael (BB)

( * ) Notice: Subject to any disclaimer, the term of this patent is extended or adjusted under 35 U.S.C. 154(b) by 150 days.

(21) Appl. No.: 17/259,600

(22) PCT Filed: Jun. 25, 2019

(86) PCT No.: PCT/EP2019/066888
§ 371 (c)(1),
(2) Date: Jan. 12, 2021

(87) PCT Pub. No.: WO2020/011528
PCT Pub. Date: Jan. 16, 2020

(65) Prior Publication Data

US 2021/0317808 A1 Oct. 14, 2021

(30) Foreign Application Priority Data

Jul. 13, 2018 (GB) ..... 1811499

(51) Int. Cl.
*F02M 65/00* (2006.01)

(52) U.S. Cl.
CPC ..... *F02M 65/00* (2013.01)

(58) Field of Classification Search
CPC ..... F02M 65/00
See application file for complete search history.

(56) References Cited

U.S. PATENT DOCUMENTS

| | | | | |
|---|---|---|---|---|
| 2,744,407 | A | 5/1956 | Kruger et al. | |
| 5,000,043 | A | 3/1991 | Bunch et al. | |
| 5,307,782 | A | 5/1994 | Davis | |
| D352,806 | S * | 11/1994 | Skovron | D18/50 |
| 6,234,002 | B1 * | 5/2001 | Sisney | F02M 65/001 73/116.04 |

(Continued)

FOREIGN PATENT DOCUMENTS

| | | | |
|---|---|---|---|
| CN | 106224678 | A | 12/2016 |
| DE | 144435 | A1 | 10/1980 |

(Continued)

OTHER PUBLICATIONS

Machine assisted English translation of JPH0949471A obtained from https://patents.google.com/patent on Jul. 22, 2022, 10 pages.

*Primary Examiner* — Eric S. McCall
(74) *Attorney, Agent, or Firm* — Warner Norcross + Judd LLP

(57) ABSTRACT

A testing apparatus for a fuel injector includes an upper mount for receiving an inlet of the fuel injector; a lower mount located beneath the upper mount for receiving a nozzle end of the fuel injector; and at least one of a removable inlet adaptor and a removeable outlet adapter. The inlet of the fuel injector fits into the inlet adaptor to allow a flow of fluid to be delivered through the inlet adaptor to the fuel injector and removable from the upper mount. The removable outlet adaptor removable from the lower mount.

16 Claims, 14 Drawing Sheets

(56) References Cited

U.S. PATENT DOCUMENTS

| | | | | |
|---|---|---|---|---|
| 2002/0138984 | A1* | 10/2002 | Dallmeyer | F02M 51/005 29/407.01 |
| 2003/0051542 | A1* | 3/2003 | Panek | F02M 65/00 73/114.79 |
| 2007/0157716 | A1* | 7/2007 | Kortsen | F02M 65/003 73/114.45 |
| 2007/0240500 | A1* | 10/2007 | Pollard | F02M 65/00 73/114.48 |
| 2013/0031775 | A1* | 2/2013 | Cueto | F16L 21/00 29/700 |
| 2013/0206937 | A1 | 8/2013 | Kordass et al. | |
| 2013/0291631 | A1 | 11/2013 | Kordass et al. | |
| 2016/0265706 | A1 | 9/2016 | Novellani et al. | |
| 2018/0372050 | A1* | 12/2018 | McCormack | F02M 65/006 |
| 2020/0340439 | A1* | 10/2020 | Jacobs | F02M 65/00 |
| 2022/0065209 | A1* | 3/2022 | Arseneau | F02M 65/001 |

FOREIGN PATENT DOCUMENTS

| | | | |
|---|---|---|---|
| DE | 10103899 | A1 | 8/2002 |
| GB | 872247 | A | 7/1961 |
| GB | 1038546 | A | 8/1966 |
| GB | 2432885 | A | 6/2007 |
| JP | 09049471 | A | 2/1997 |
| JP | H0949471 | A | 2/1997 |

* cited by examiner

TESTING APPARATUS FOR A FUEL INJECTOR

CROSS REFERENCE TO RELATED APPLICATIONS

This application is a national stage application under 35 USC 371 of PCT Application No. PCT/EP2019/066888 having an international filing date of Jun. 25, 2019, which is designated in the United States and which claimed the benefit of GB Patent Application No. 1811499.1 filed on Jul. 13, 2018, the entire disclosures of each are hereby incorporated by reference in their entirety.

TECHNICAL FIELD

The invention relates to an apparatus for testing injectors for injecting fuel into an internal combustion engine. The invention also relates to a method of testing fuel injectors using a testing apparatus.

BACKGROUND TO THE INVENTION

It is known to use testing apparatus to check the suitability of fuel injectors prior to their installation in engines. One known testing apparatus for diesel fuel injectors (for use in compression ignition internal combustion engines) measures characteristics of the spray of fuel from the injector, including the flow rate of fuel delivered by the injector, the quantity of fuel delivered by the injector and the fuel spray pattern from the injector outlets. The spray pattern is often measured only by visual inspection by a highly-trained user and often the measurements are not sufficient to determine all characteristics of the injected spray accurately.

Whilst such testing apparatus is commonly used for diesel fuel injectors, it is not suitable for use in testing gasoline fuel injectors due to various different injector requirements. Although the means of injection in a diesel injector and a gasoline injector is the same, with a valve needle being actuated to open and close outlets of the injector to inject a fuel spray through the outlets, the assembly of the injector is different for a diesel injector and a gasoline injector, particularly at the inlet end of the injector where fuel is delivered to the injector. Also, the pressures at which gasoline injectors are tested are much lower than for diesel injector. For example, gasoline injectors are typically tested at around 3 to 200 bar of injection pressure, whereas diesel fuel injectors are typically tested at over 200 to 2000 bar. It is not therefore straightforward, nor is it known, to use a testing apparatus which can accommodate both types of injector.

It is one object of the invention to overcome at least the aforementioned problem.

SUMMARY OF THE INVENTION

According to one aspect of the present invention, there is provided a testing apparatus for a fuel injector for delivering fuel into an internal combustion engine, in use, wherein the fuel injector under test comprises an inlet for receiving fluid to be injected during a test and a nozzle end for delivering the fluid through an injector outlet, in use, the testing apparatus comprising an upper mount for receiving the inlet of the fuel injector under test; and a lower mount located beneath the upper mount for receiving the nozzle end of the fuel injector under test. The testing apparatus comprises at least one of a removable inlet adaptor for use with a fuel injector under test of a first type, wherein the inlet end of the fuel injector under test of the first type fits into the inlet adaptor to allow a flow of fluid to be delivered through the inlet adaptor to the fuel injector under test of the first type, the inlet adaptor being removable from the upper mount when the fuel injector under test is of a second type or being interchangeable with a different inlet adaptor when the fuel injector under test is of a second type; and a removable outlet adaptor for use with a fuel injector under test of the first type, the removable outlet adaptor being mounted within the lower mount when the fuel injector under test is of the first type, and being removable from the lower mount when the fuel injector under test is of a second type or being interchangeable with a different outlet adaptor when the fuel injector under test is of a second type.

One advantage of the invention is that the testing apparatus can be used to test different types of injector using the apparatus, without the need to invest in expensive and different equipment for each type of testing. This provides benefits for service centres and engine suppliers, as well as downstream benefits customers in terms of service cost and speed. In particular, the testing apparatus may be used to test both gasoline and diesel injectors using the same apparatus, simply by using an appropriate adaptor, or by removing an adaptor if not required. This may be achieved despite the different geometries and requirements of testing for these two types of injector.

Different injector types by reference to their size and shape may also be tested using the same apparatus, but simply by changing the necessary inlet and/or outlet adaptor. Typically, however, the outlet adaptor will always be used.

In one embodiment, the testing apparatus comprises a removable target assembly having a target plate comprising a fluid spray impact surface which fluid injected by the fuel injector under test impinges during testing in a second test mode.

The target plate includes a spray target pattern denoted on the fluid spray impact surface.

The testing apparatus may further comprise a housing for the target plate, wherein the housing mounts onto the lower mount and defines at least one opening in a sidewall of the housing so as to permit visual inspection of the injected fluid spray from the fuel injector under test, during testing.

In another aspect of the invention, therefore, there is provided a testing apparatus for a fuel injector, wherein the fuel injector under test comprises an inlet for receiving a flow of fluid to be injected and a nozzle end for delivering the flow of fluid through an injector outlet. The testing apparatus comprises an upper mount for receiving the inlet of the fuel injector under test; and a lower mount located beneath the upper mount for receiving the nozzle end of the fuel injector under test. The testing apparatus further comprises a removable target assembly having a target plate comprising a fluid spray impact surface which fluid injected by the fuel injector under test impinges during testing, and a housing for the target plate, wherein the housing mounts onto the lower mount and defines at least one opening in a sidewall of the housing so as to permit visual inspection of the injected fluid spray from the fuel injector under test, during testing.

A further advantage of the invention is provided by the target plate feature which carries a target spray pattern and allows for visual inspection of the fuel spray from the fuel injector under test through a sidewall in the housing for the target plate. This provides the user of the testing apparatus with a means for viewing the fuel spray both from the side (through the sidewall) and "end-on" (by viewing the target plate). The use of the spray target pattern on the target plate aids the user in identifying traits of the fuel spray which may not otherwise be visible.

In another embodiment, the testing apparatus comprises a fluid flow measurement device, located downstream of the fuel injector under test in an outlet line from the fuel injector, wherein the fluid flow measurement device is provided with a damper device to limit fluctuations in fluid pressure within the supply line. The damper device may include a damper inlet and a damper outlet and at least one chamber (for example, a U-shaped chamber), located in a flow path between the damper inlet and the damper outlet, and a restriction located at an exit port from at least one of the chambers, wherein the restriction is positioned so that fluid exits through the restriction rather than filling the chamber completely, thereby defining a cavity within the chamber which is filled with trapped air at atmospheric pressure which acts as a damping medium for fluid flowing through the damper device during injector testing.

According to another aspect of the invention, therefore, there is provided a testing apparatus for a fuel injector, wherein the fuel injector under test comprises an inlet for receiving a flow of fluid to be injected and a nozzle end for delivering the flow of fluid through an injector outlet. The testing apparatus comprises an upper mount for receiving the inlet of the fuel injector under test; and a lower mount located beneath the upper mount for receiving the nozzle end of the fuel injector under test. The testing apparatus further comprises a fluid flow measurement device, located downstream of the fuel injector in an outlet line from the fuel injector under test, wherein the fluid flow measurement device is provided with a damper device to limit fluctuations in fluid pressure within the supply line. The damper device includes a damper inlet and a damper outlet and at least one chamber located in a flow path between the damper inlet and the damper outlet, and a restriction located at an exit port from at least one of the chambers, wherein the restriction is positioned so that fluid exits through the restriction rather than filling the chamber completely, thereby defining a cavity within the chamber which is filled with trapped air at atmospheric pressure which acts as a damping medium for fluid flowing through the damper device during injector testing.

In one embodiment, the removable inlet adaptor comprises an inlet port having an adaptor screw thread for connection, in use, with a primary screw thread on an outlet port of a fluid supply apparatus to the testing apparatus.

The removable outlet adaptor may be included in the apparatus when the fuel injector under test of the first type has a nozzle end of relatively small diameter, the outlet adaptor being interchangeable with another outlet adaptor of a different type in the event of testing a fuel injector of a second type having a nozzle end with a relatively large diameter.

The testing apparatus may further comprise a support structure for mounting the upper mount onto the lower mount, wherein the fuel injector under test extends through the support structure when received in the apparatus for testing.

The testing apparatus may further comprises a removable delivery chamber located beneath the lower mount for receiving injected fluid from the fuel injector under test in a first test mode.

The testing apparatus may further comprise a clamp arrangement which cooperates with the lower mount to clamp the delivery chamber and the lower mount together.

The testing apparatus may further comprise an annular seal received within the removable outlet adaptor and through which the fuel injector under test is received.

The testing apparatus may further comprise a removable target assembly having a target plate comprising a fluid spray impact surface which is impinged by fluid injected by the fuel injector under test during testing in a second test mode.

In one embodiment, the target plate includes a spray target pattern denoted on the fluid spray impact surface.

The testing apparatus may further comprise a housing for the target plate, wherein the housing mounts onto the lower mount and defines at least one opening in a sidewall of the housing so as to permit visual inspection of the injected fluid spray from the fuel injector under test, during testing.

The testing apparatus may further comprise a fluid flow measurement device, located downstream of the fuel injector in an outlet line from the fuel injector under test, wherein the fluid flow measurement device is provided with a damper device to limit fluctuations in fluid pressure within the outlet line.

In one embodiment the damper device may include a damper inlet and a damper outlet and at least one chamber, located in a flow path between the damper inlet and the damper outlet, and a restriction located at an exit port from the at least one chamber, wherein the chamber defines a cavity filled with trapped air at atmospheric pressure which acts as a damping medium for fluid flowing through the damper device during injector testing. The restriction is positioned at the exit port from each chamber so that fluid flows through the restriction, rather than filling the cavity, and leaving the cavity filled with air at atmospheric pressure.

The damper device may include a plurality of said chambers arranged in series between the damper inlet and the damper outlet.

For example, each chamber may be of uniform cross section around an annular circumference thereof.

In this case the flow path through the damper device may be linear.

In another embodiment, the chamber is of non-uniform cross-section around an annular circumference thereof so as to define a region of relatively great volume on one side of the device and a region of relatively smaller volume on the other side of the device.

Embodiments are also envisaged in which the flow path through the damper device is convoluted.

The testing apparatus may be used with a fuel injector of a first type being a gasoline injector and a fuel injector of a second type being a diesel injector.

According to a further aspect of the invention, there is provided a method of testing an injector using a testing apparatus as claimed in any preceding claim, the method comprising mounting a removable inlet adaptor in the upper mount when the fuel injector under test is of a first type, the inlet adaptor being removable from the upper mount when the fuel injector under test is of the second type or being interchanged with a different inlet adaptor when the fuel injector under test is of a second type; and mounting a removable outlet adaptor within the lower mount when the fuel injector under test is of the first type, the outlet adaptor being removed when the fuel injector under test is of the second type or being interchanged with a different outlet adaptor when the fuel injector under test is of a second type.

Within the scope of this application it is expressly intended that the various aspects, embodiments, examples and alternatives set out in the preceding paragraphs, in the description and drawings, and in particular the individual features thereof, may be taken independently or in any combination. That is, all embodiments and/or features of any embodiment can be combined in any way and/or combination, unless such features are incompatible.

DETAILED DESCRIPTION OF PREFERRED EMBODIMENTS

Figure 1:
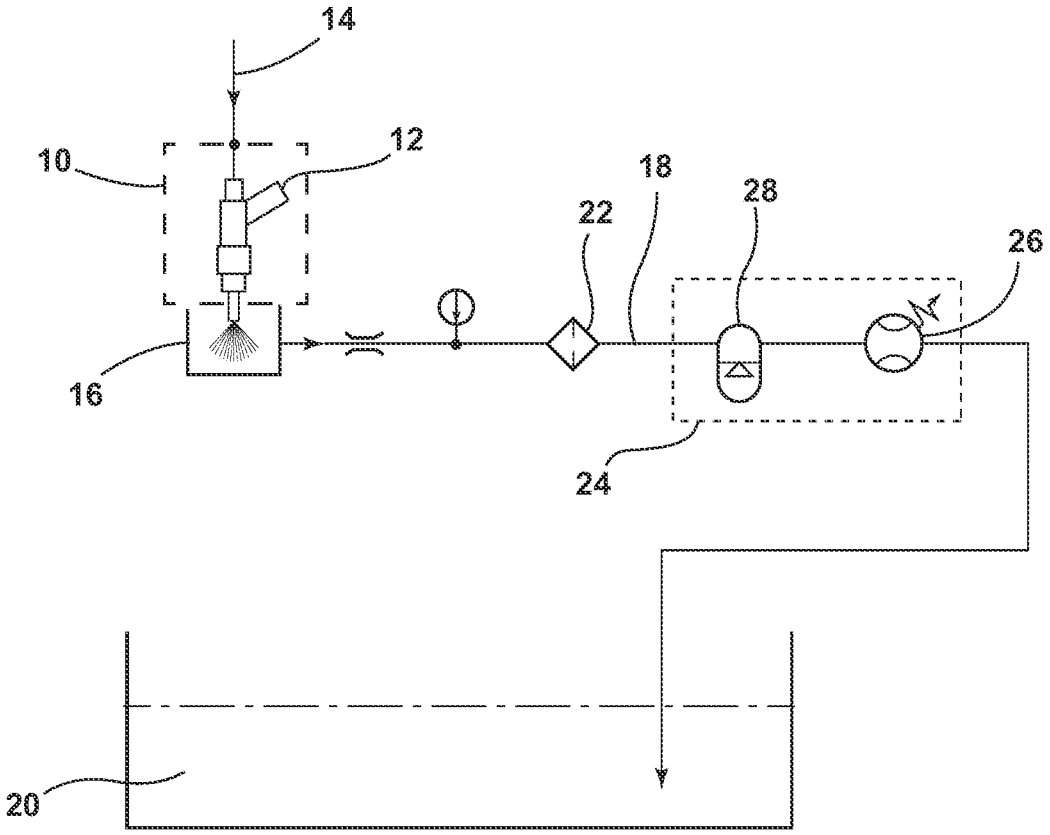
FIG. 1 is a schematic diagram of a fuel injector testing apparatus of an embodiment of the invention, for testing different injector types, including a fluid measurement device.

It should be understood that the terms 'upper' and 'lower' are used for convenience, and refer to the orientation of the injector as illustrated in the drawings. However, these terms are not intended to limit the scope of the invention or imply any limitations on the actual orientation of the injector in use.

FIG. 1 shows a schematic diagram of a testing apparatus of the invention which may be used for testing injectors of different types, and typically an injector of a first type being a diesel injector and an injector of a second type being a gasoline injector. Alternatively the apparatus may be used to test injectors which deliver the same type of fuel, but which are configured differently e.g. have a different hardware configuration such as different diameter inlet and outlet ends of the injector.

The testing apparatus includes a primary apparatus in the form of a test machine (not shown) which supplies fuel to an injector mounted within an injector mounting apparatus, referred to generally as 10. When fitted into the injector mounting apparatus 10, an injector 12 under test is supplied with a test fluid from a high pressure supply 14 and injects fluid into a delivery chamber apparatus 16 defining a delivery chamber (not shown in FIG. 1). Fluid in the delivery chamber flows through an outlet path 18 of the primary apparatus to a test fluid tank 20 through a filtration system 22. Having passed through the filtration system 22, the fluid passes through a fluid measurement apparatus 24 including a fluid measurement device 26 and an associated damper device 28, as will be discussed in further detail below, into the fluid tank 20. The fluid measurement device 26 measures the quantity and other characteristics of the fluid that is injected into the outlet path 18

Figure 2:
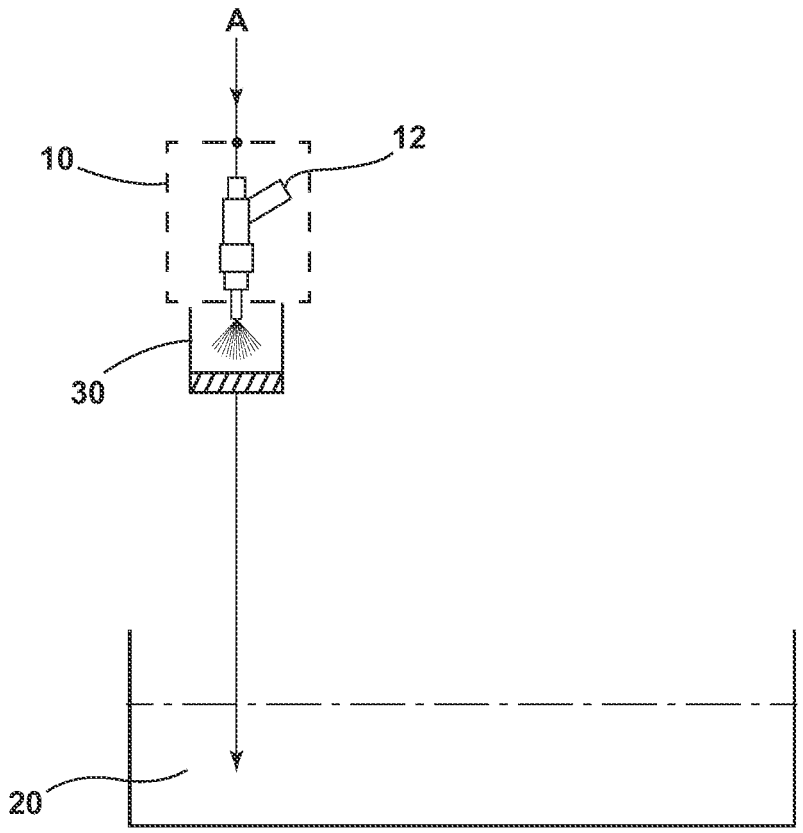
FIG. 2 is a schematic diagram of a fuel injector testing apparatus of an alternative embodiment of the invention, for testing different injector types, but with a spray target apparatus fitted instead of the delivery chamber apparatus.

FIG. 2 shows a schematic diagram of the testing apparatus in FIG. 1 but with the delivery chamber apparatus 16 removed and instead a spray target apparatus 30 mounted at an outlet of the injector instead. Fluid delivered into the spray target apparatus is delivered straight to the fluid tank.

The different testing methods involving the delivery chamber apparatus 16 of FIG. 1 and the spray target apparatus 30 of FIG. 2 will be described in further detail below.

Figure 3:
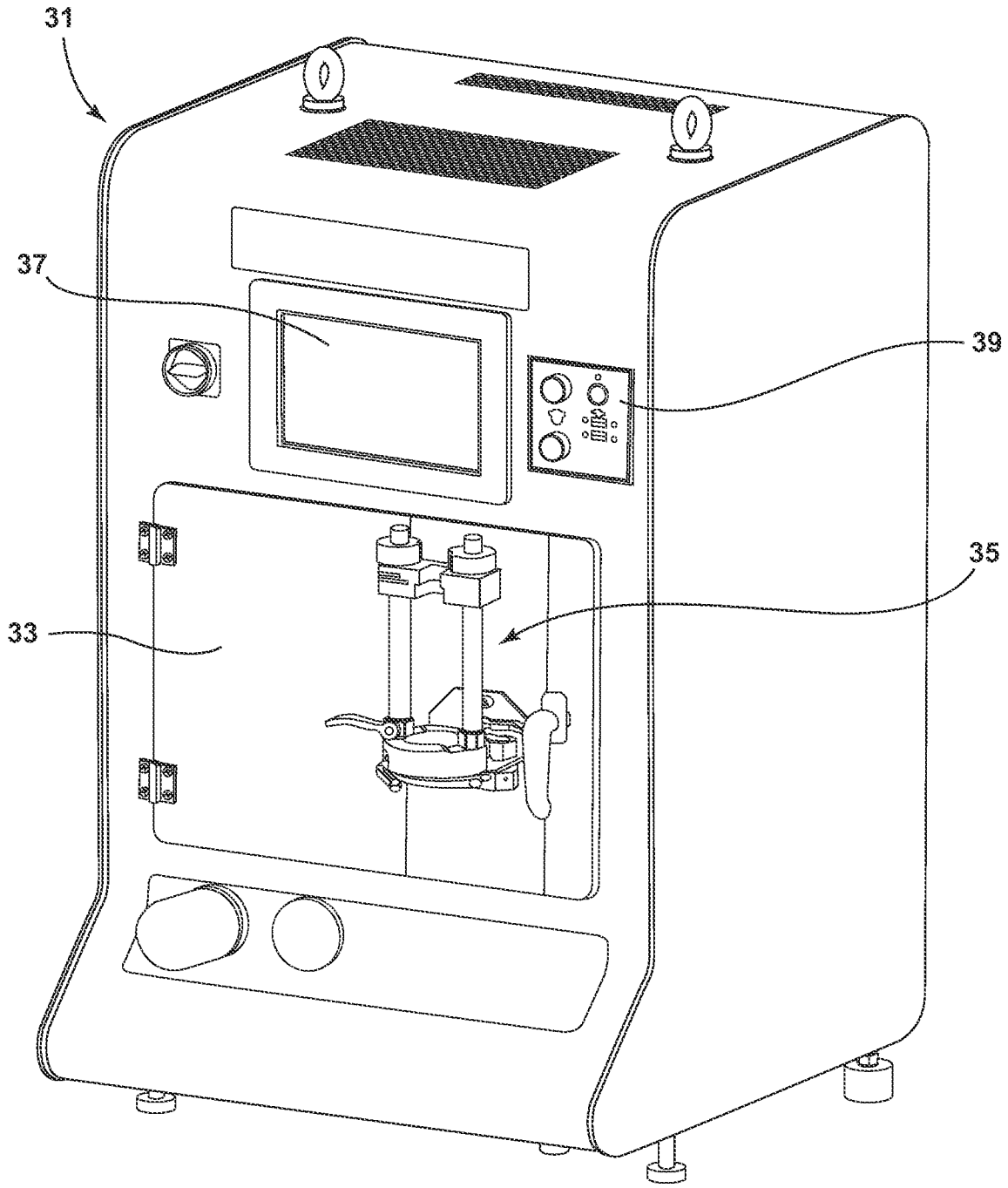
FIG. 3 is a perspective view of the testing apparatus of FIGS. 1 and 2, including an injector mounting apparatus.

FIG. 3 is a perspective view of the testing apparatus, referring to generally as 31. The apparatus includes an internal chamber 33 (typically located behind a door) for receiving an injector mounting apparatus 35 for a fuel injector to be tested (the injector is not shown in FIG. 3). The injector mounting apparatus will be described in further detail later. A display panel 37 may be used to provide an indication to the user about the status of various features of the apparatus and/or the injector under test. Various control features on a control panel 39 are also provided in the apparatus.

In a conventional testing apparatus, an outlet port on the testing apparatus which deliver test fluid to the injector carries a screw threaded nut (referred to as the primary screw thread) to permit connection with a screw-threaded inlet port of a diesel injector, for example, to be tested. However, in the testing apparatus of the present invention it is desirable to be able to test gasoline injectors too, and/or a variety of different injector sizes, but such injectors do not carry a threaded inlet port. Hence, in the injector mounting apparatus an inlet adaptor is provided to allow the unthreaded inlet port of the gasoline injector to connect with the outlet port via the threaded nut of the apparatus.

Figure 4:
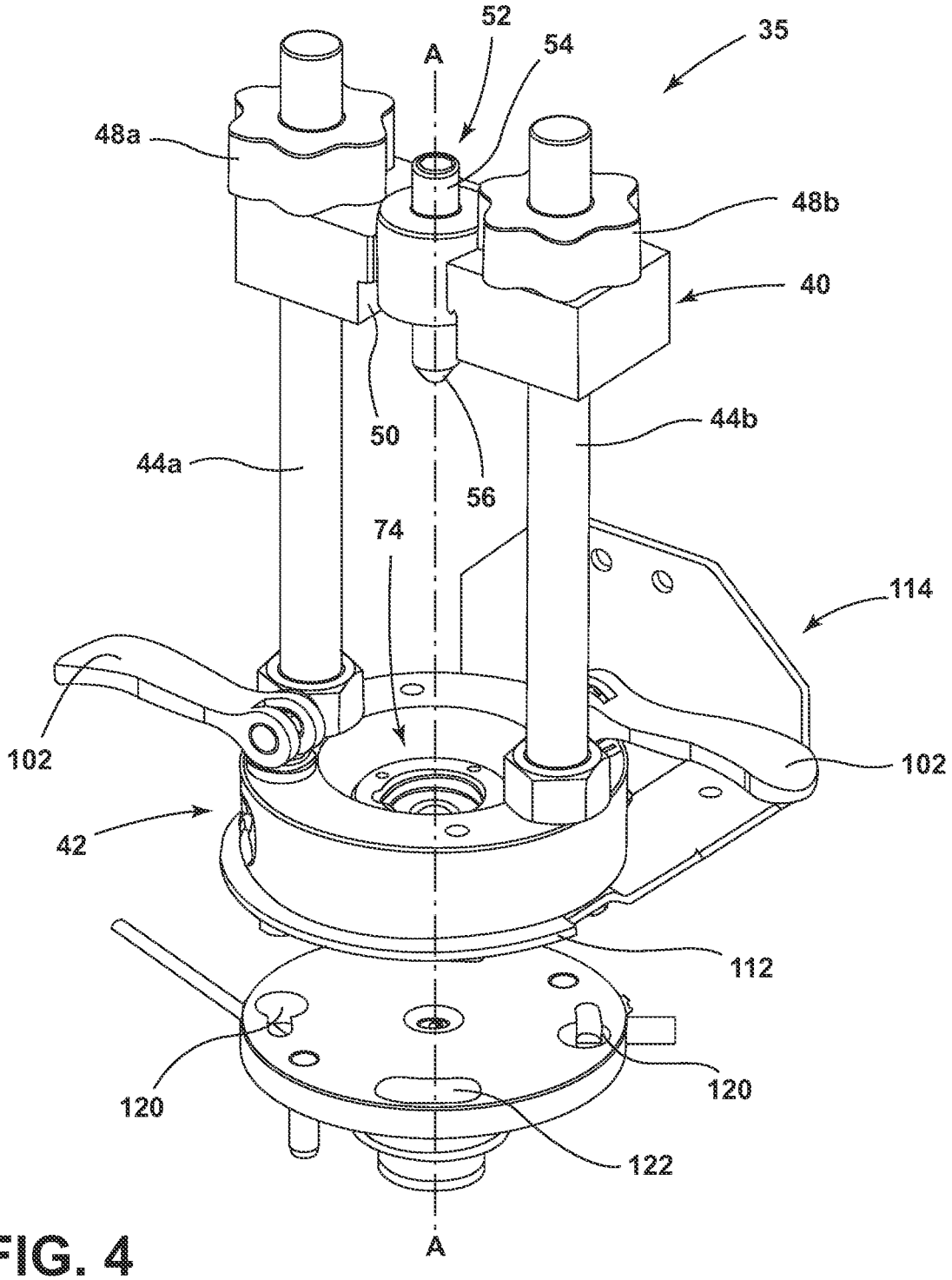
FIG. 4 is a perspective view of the injector mounting apparatus forming part of the testing apparatus in FIG. 3, including inlet and outlet adaptors, and with a delivery chamber apparatus detached from the lower mount of the apparatus.
Figure 5:
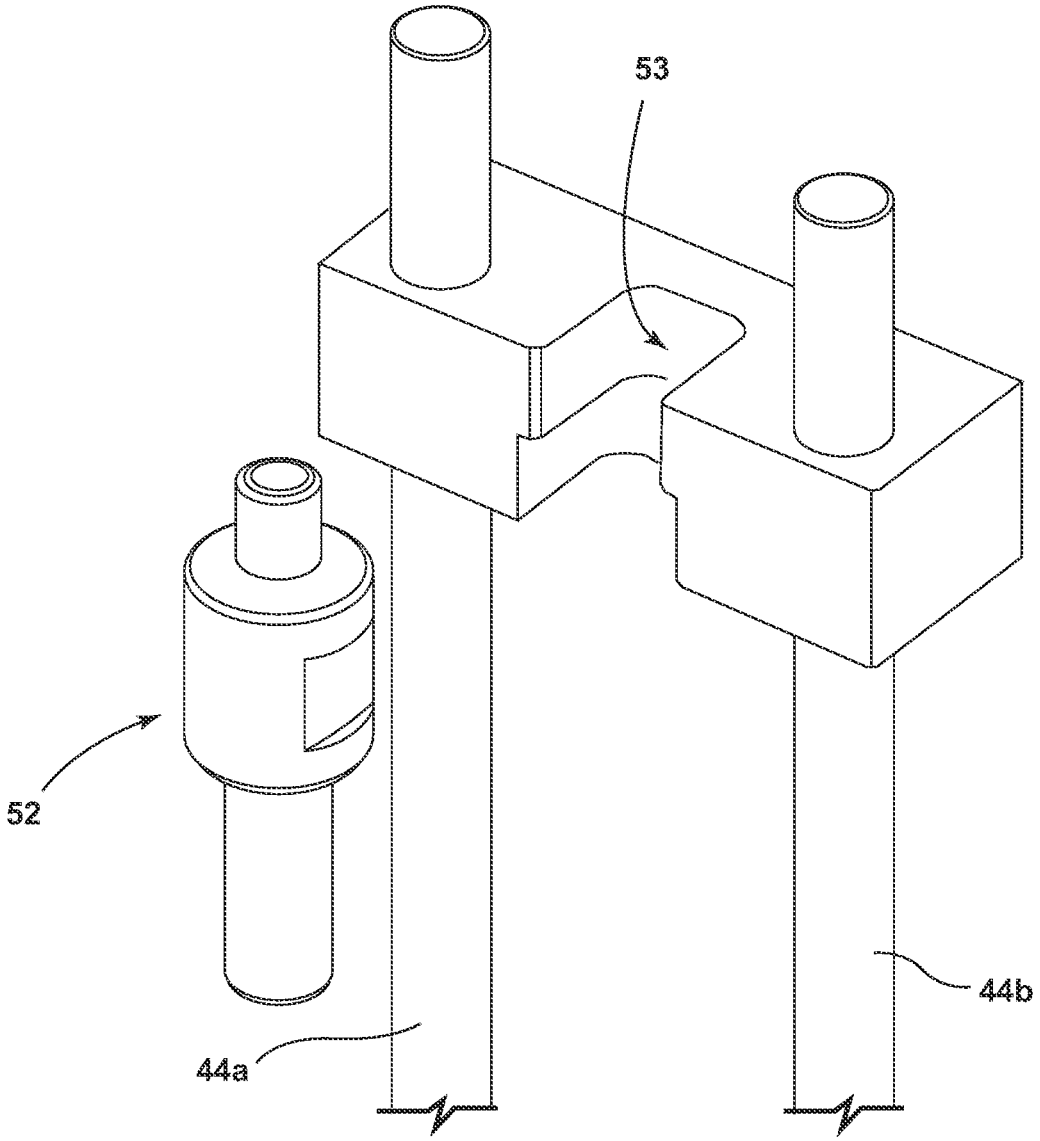
FIG. 5 is a perspective view of an upper end of the injector mounting apparatus in FIG. 4, showing the inlet adaptor when removed from the apparatus.
Figure 6:
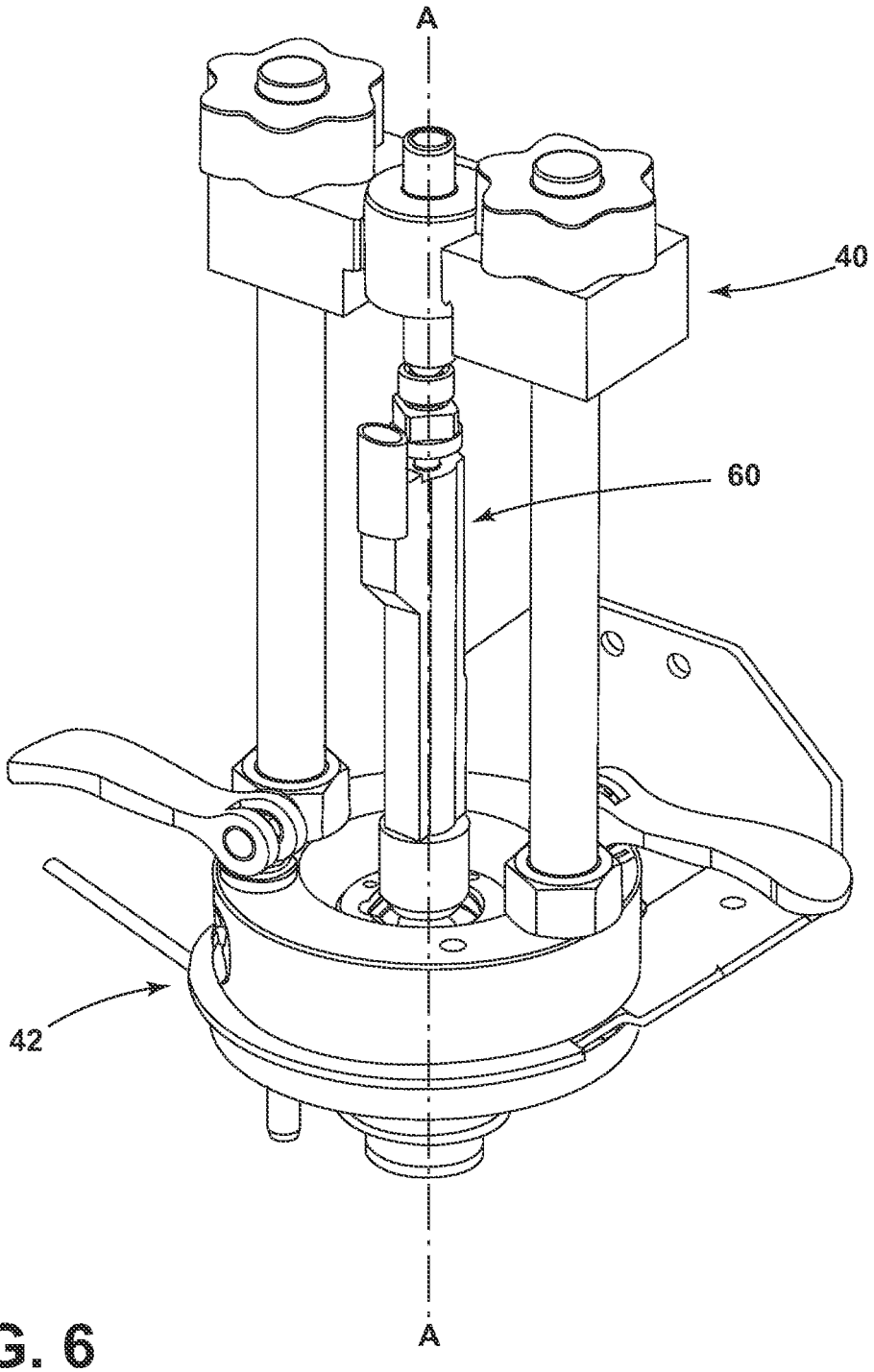
FIG. 6 is a perspective view of the injector mounting apparatus in FIG. 4 with a gasoline fuel injector fitted in the apparatus and the delivery chamber apparatus attached to the lower mount of the apparatus.

Referring to FIGS. 4 to 6, the injector mounting apparatus 35 has a longitudinal axis A-A and includes an upper mount 40 and a lower mount 42 for holding, respectively, inlet and outlet ends of the fuel injector under test (the injector is only shown in FIG. 6). The upper mount 40 resides above the lower mount and the two are connected together by means of a support structure comprising first and second elongate threaded struts 44*a*, 44*b*, or studs, on opposed sides of the mounting apparatus.

The upper mount 40 takes the form of a block which is provided with a central slot 53 (as seen in FIG. 5) for receiving an inlet adaptor 52. The slot 53 defines an inwardly facing curved surface 50 which is shaped to receive the cylindrical outer surface of the inlet adaptor 52. On either side of the slot 53 the upper mount 52 is connected to an upper end of a respective one of the struts 44*a*, 44*b* via the screw thread on the struts and a threaded nut 48*a*, 48*b* on each strut. When fitted into the upper mount 40 the inlet adaptor 52 is located on the injector centre-line axis A-A and is restrained by the upper mount both longitudinally and rotationally.

The inlet adaptor 52 includes a screw-threaded inlet port 54 for connection with the screw-threaded nut (not shown) of the primary testing apparatus, as mentioned above, and an outlet port 56 which is shaped to connect with the inlet of an injector to be tested. The injector 60 is not shown in FIGS. 4 and 5, but can be seen mounted in the injector mounting apparatus in FIG. 6.

Figure 7:
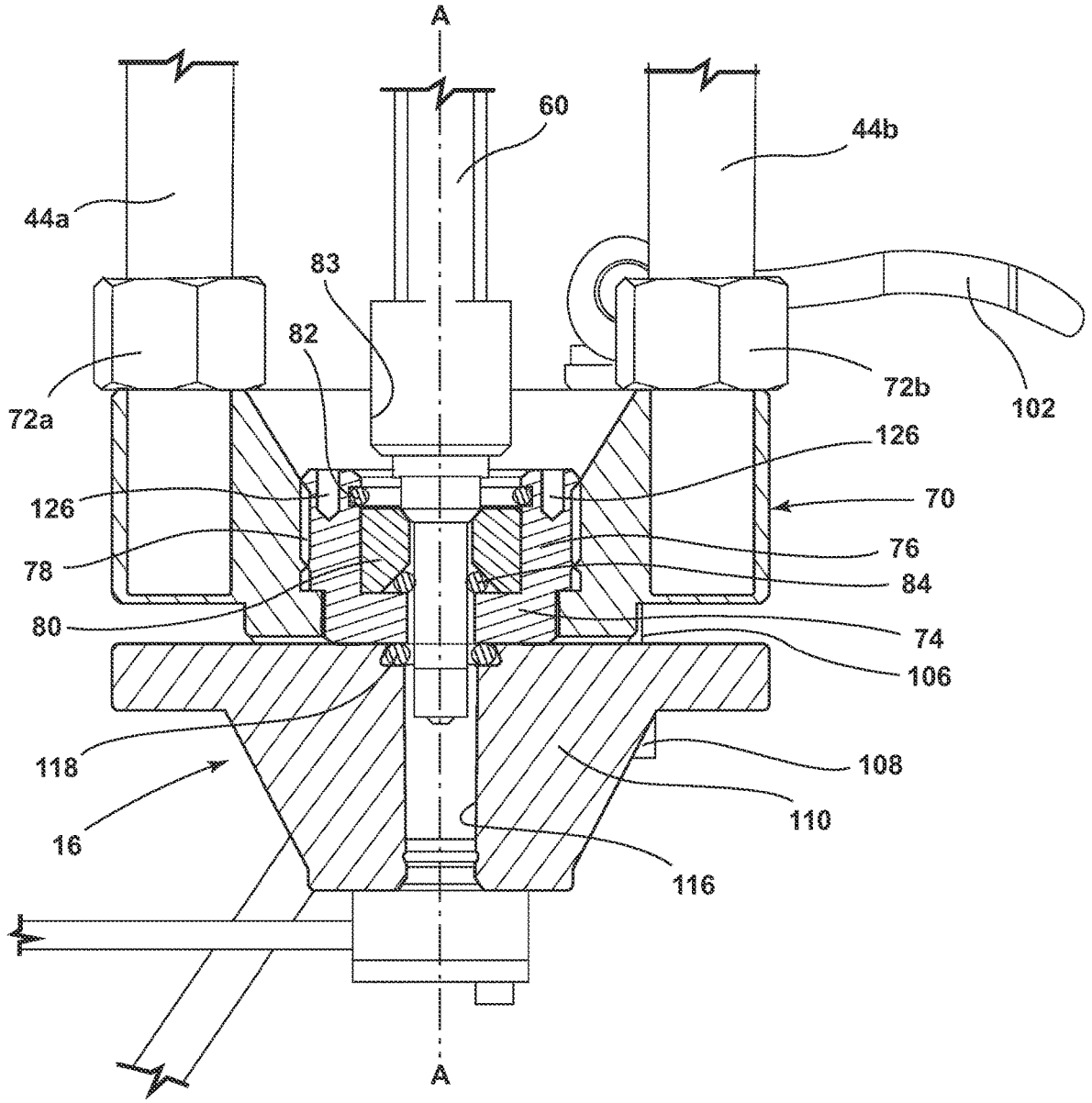
FIG. 7 is a cross-sectional view of the lower mount of the testing apparatus in more detail, with the gasoline fuel injector and a delivery chamber apparatus fitted into the injector mounting apparatus.

Referring also to FIG. 7, at the lower end of the injector mounting apparatus the lower mount 42 provides a support for a nozzle outlet end of the injector 60 under test. The lower mount 42 includes a base block 70 through which the lower ends of the struts 44*a*, 44*b* are received, on opposed sides, via a screw threaded connection on respective nuts 72*a*, 72*b*.

An outlet adaptor 74 is received within the base block 70. The outlet adaptor 74 defines a through hole along the central axis through which the injector 60 is received in a sealing fashion, as will be described further below. One type of outlet adaptor 74 (as shown in FIG. 7) comprises two parts; an outer annular ring 76 and an inner annular ring 80 received within the outer annular ring 76. The outer annular ring 76 is secured into the base block 70 in a screw thread connection 78.

The outlet adaptor 74 is further provided with first (upper) and second (lower) O-ring seals. The upper seal 82 rests on top of the inner annular ring 80 and locates within an internal groove towards the upper end of the outer annular ring 76. The lower seal 84 resides within a conical recess formed in a lower surface of the inner annular ring 80. The lower seal 84 provides a hydraulic seal with the injector 60 to prevent leakage of fluid, whereas the upper seal 82 provides an assembly aid and prevents the inner annular ring 80 being removed from the outer annular ring 76 when the injector under test 60 is removed from the apparatus.

A clamping arrangement 100 comprising first and second clamping arms (only one of which 102 is visible in FIG. 7) is provided on an upper surface of the lower mount 42. Each clamping arm 100 is manually operable to tighten or release the clamping arrangement when it is required to attach or detach the delivery chamber apparatus 16. A fixing in the form of a rod 106 (just visible in FIG. 7) extends from each clamping arrangement, terminating at its lower end in an enlarged head 108. The lever action of each clamping arm 102 serves to move its rod along an axis parallel with the longitudinal axis A-A of the injector mounting assembly.

A delivery chamber plate 110 is located beneath the lower mount and forms a part of the delivery chamber apparatus 16 identified in FIG. 1. The delivery chamber apparatus 16 is attached the lower mount 42 by means of the clamping arrangement 102 and fixings described previously. The delivery chamber plate 110 is aligned with the longitudinal axis A-A of the injector assembly so that the outlet end of the injector 60 extends into a passage 116 provided in the plate 110. The passage defines a chamber into which fluid is injected by the injector 60 under test, in use. A seal 118 is provided around a lower end of the injector 60 to seal the delivery chamber apparatus 16 to the underside of the outlet adaptor 74.

A lower bracket 114 is mounted beneath the lower mount 42 and is used to mount a spray target apparatus to the injector mounting apparatus when the delivery chamber apparatus 16 is removed, as described further below. The lower bracket 114 includes an annular plate 112 which has a central aperture which aligns with the longitudinal axis A-A. The plate 112 is attached to an extended portion of the bracket which protects laterally from the longitudinal axis A-A.

Referring again to FIG. 4, the delivery chamber plate 110 is provided with a plurality of apertures, a first pair of opposed apertures 120 and a second pair of opposed apertures 122 interspersed between the first pair. Each aperture 120 of the first pair is key-shaped, with an enlarged end and a narrow end. A respective one of the rods 106 of the clamping arrangement is received through a respective aperture 120 of the first pair by passing the enlarged head 108 through the enlarged end of the aperture 120 so that it projects from the underside of the delivery chamber plate 110. If the delivery chamber plate 110 is then moved angularly about the longitudinal axis A-A of the injector assembly, the rod 106 moves through the aperture so that the enlarged head moves from beneath the enlarged end of the aperture into the narrow end, so that the rod 106 cannot then be removed upwardly through the aperture. As a user pushes down on the clamping arm 100 the rod is therefore drawn upwards, against the underside of the delivery chamber plate 100, to exert a clamping force on the lower mount 42, clamping the delivery chamber plate 110 and the lower mount 42, including the outlet adaptor 74, together.

A clamping force also serves to force the lower seal 84 against the injector 60 to provide a substantially fluid-tight seal with the injector as the nuts 48*a*, 48*b* are tightened onto the struts 44*a*, 44*b*.

In other words, the delivery chamber includes a delivery chamber plate provided with a plurality of recesses, and wherein the clamp arrangement includes a plurality of fixings, each of which is received within a respective one of the recesses, and wherein the delivery chamber is movable angularly about a longitudinal axis of the fuel injector under test to move the position of each fixing within its respective recess so that each fixing is removable from its recess when the delivery chamber is in a first angular position and is fixed within the recess when the delivery chamber is in a second angular position.

Figure 8:
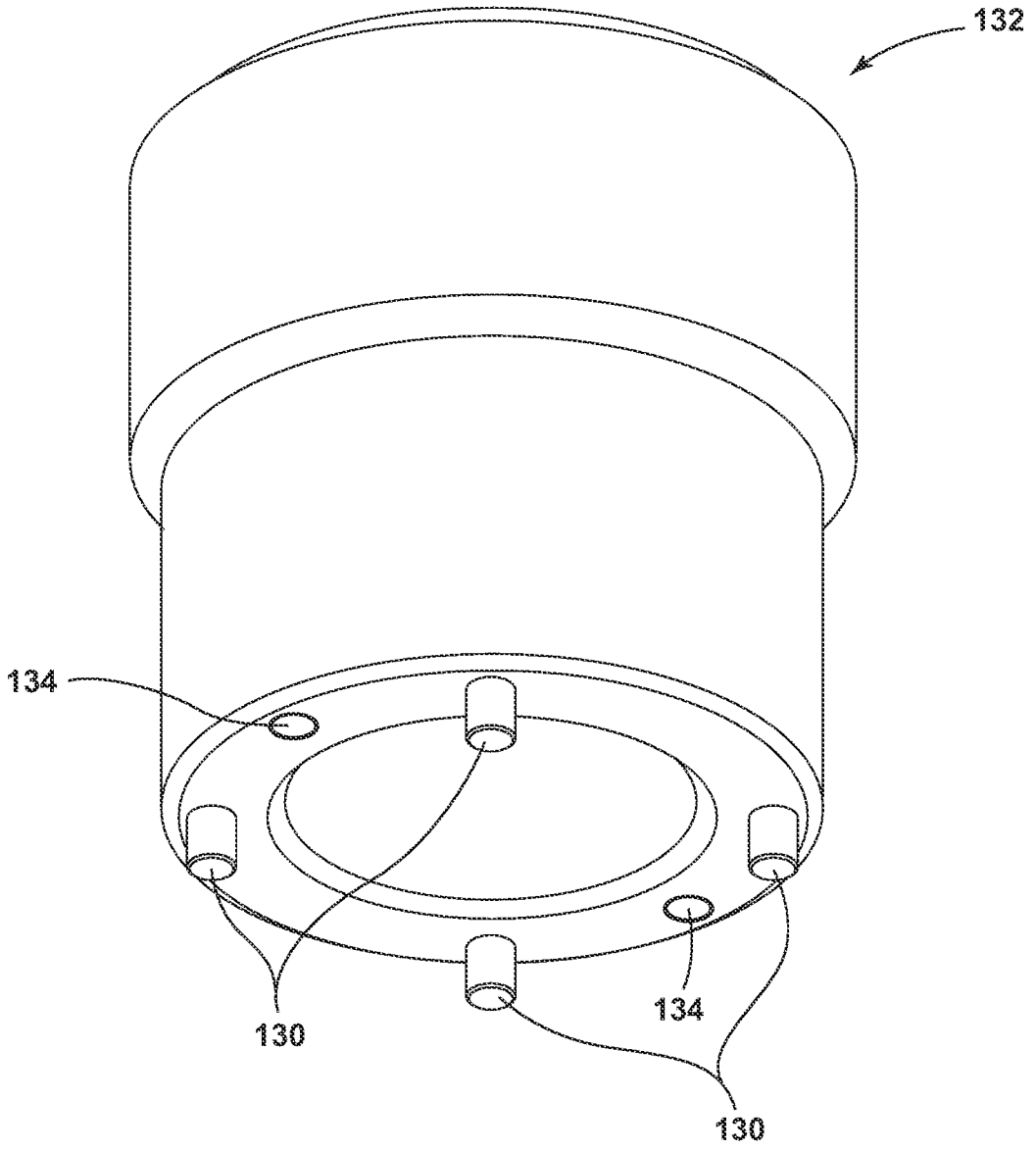
FIG. 8 is a perspective view of a tool for removal of the outlet adaptor of FIG. 4 from the testing apparatus.

The upper surface of the outer annular ring 76 of the outlet adaptor 74 is also provided with four small holes 126 (only two of which are shown in the cross section of FIG. 7). Each of the four holes 126 is arranged to receive a respective pin 130 provided on a removal tool 132, as shown in FIG. 8. The removal tool 132 is designed to permit removal of the outlet adaptor 74 from the lower base block 70 by engaging the pins 130 within the holes 126 of the outer annular ring 76. Magnets 134 are also provided on the removal tool 132 to aid the removal/insertion process for the outlet adaptor 74.

The configuration of the outlet adaptor 74 makes for a quick and convenient removal and insertion process so that the injector mounting apparatus can be adapted easily to receive an injector of a first type, in which case an outlet adaptor of a first type is used, or an injector of a second type, in which case an outlet adaptor 74 of a second type is used.

The inlet and outlet adaptors are useful where it is required to adapt the apparatus between the testing of an injector having a first set of dimensions (for example the diameter of the inlet port at the inlet end of the injector and of the outlet end at the outlet end of the injector). For the purpose of the specification, therefore, reference to injectors of a different type may refer to injectors which deliver different types of fuel, injectors which have different dimensions at their inlet and outlet ends, and injectors which have different connections at their inlet ends for receiving the fluid to be injected during testing.

Figure 9:
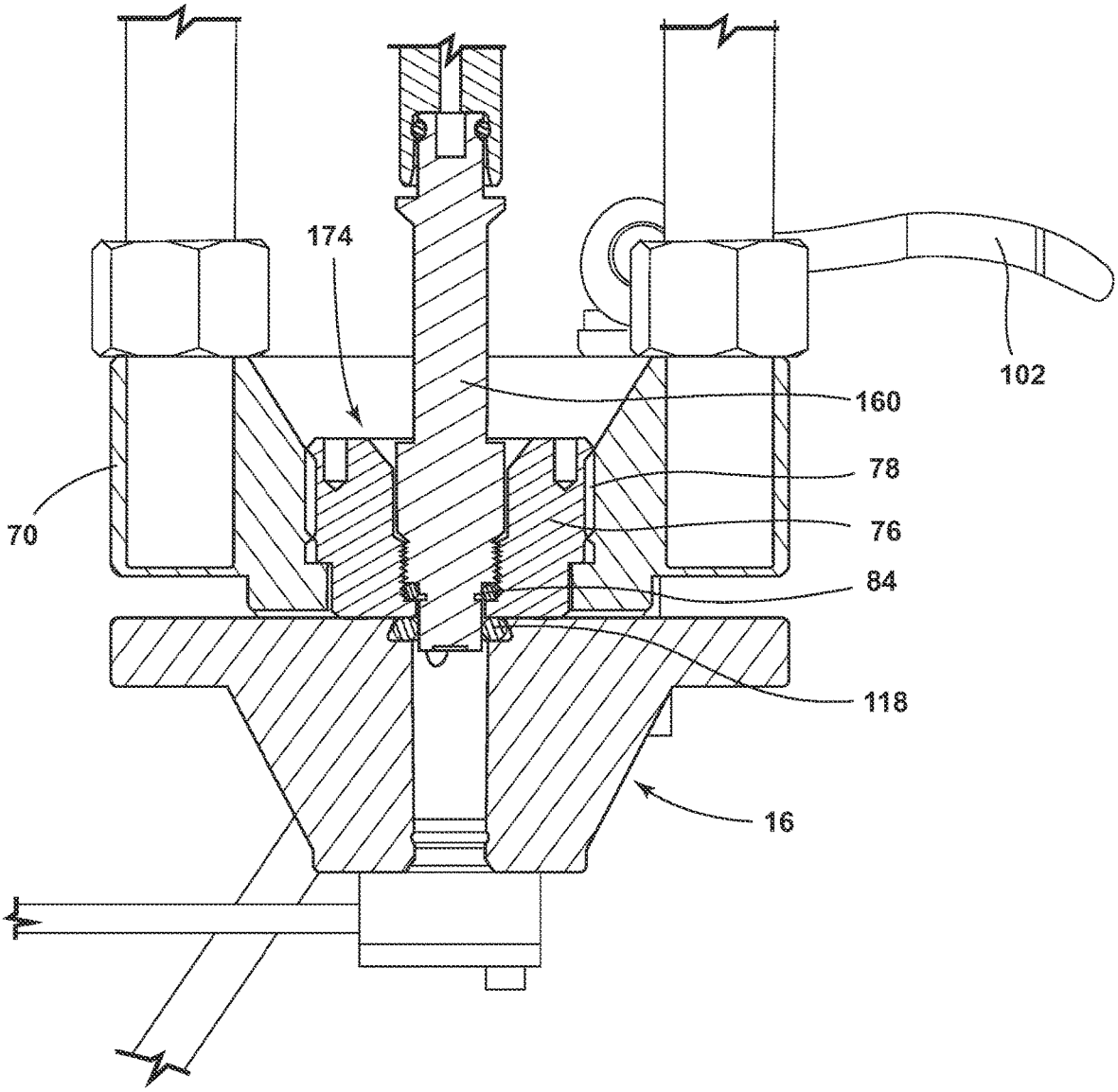
FIG. 9 is a cross-sectional view of the lower mount of the testing apparatus as in FIG. 6, but with a different type of gasoline fuel injector fitted.

By way of example, FIG. 9 is a similar figure to that shown in FIG. 7 but with a different type of injector 160 fitted into the injector mounting apparatus. In this case it can be seen that the outlet adaptor 174 is not formed of two annular rings, but is formed of just a single piece. In this case the outlet adaptor 174 does not need an inner annular ring because the nozzle end of the injector 160 has a larger diameter and fills this space. A seal 84 is provided, as in the embodiment of FIG. 7, but this engages with a step in the outer diameter of the injector 160, rather than engaging with a region of uniform diameter.

Figure 10:
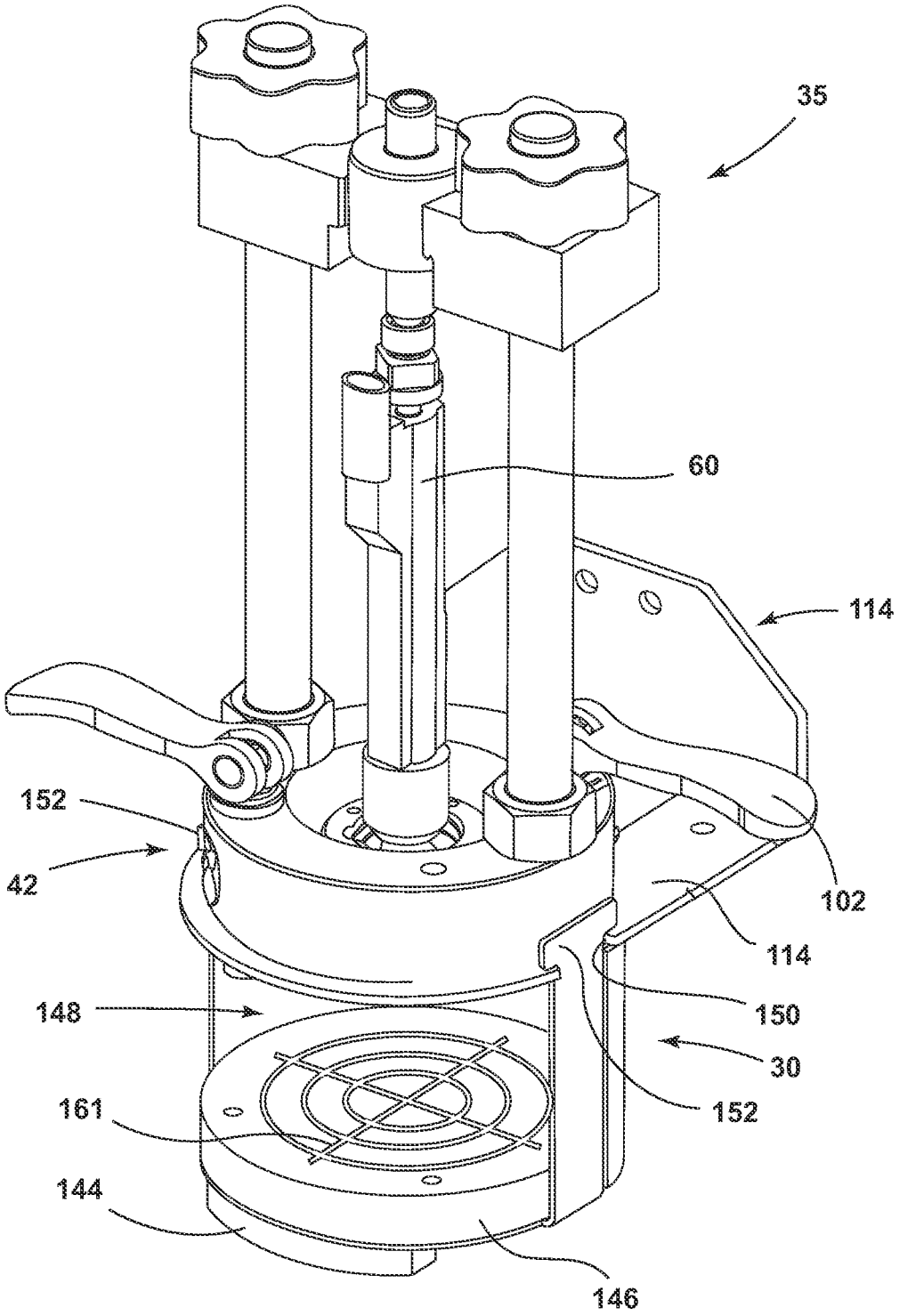
FIG. 10 is a perspective view of a lower end of the injector mounting apparatus but with a spray target plate assembly fitted to the apparatus, instead of the delivery chamber apparatus of FIG. 7.

The delivery chamber apparatus described previously is used for testing methods where it is necessary for the injected fluid to be collected in a chamber and directed to a fluid quantity measurement device for measuring fluid quantity in a first test mode, as described previously. Referring to FIG. 10, in other testing methods (e.g. a second test mode) the delivery chamber apparatus may be removed and instead a spray target apparatus 30 may be mounted to the lower mount. Fuel injectors are typically designed to have a certain number of outlets and for these holes to be positioned so that the spray jets act in a pre-defined direction to suit the engine in which they are designed to be installed. For example, an injector of a first type may have four outlets designed to jet symmetrically about the injector axis, whereas an injector of a second type may have five outlets designed to jet asymmetrically about the injector axis. The second test mode, with use of the spray target plate apparatus, is designed to activate the injector in such a way that the number and direction of spray jets can be readily identified by the operator, and compared against the desired spray jet number and direction.

In the second test mode, the spray target apparatus includes a housing having an annular sidewall 142, a base 144 and a spray target plate 146 received within a cavity 148 defined within the housing by the sidewall 142 and the base 144 so as to rest on the base in a plane perpendicular to the longitudinal axis A-A of the injector mounting apparatus and with its centre point on the longitudinal axis A-A. The bracket 114 of the lower mount 42 is provided with opposed recesses on either side of the annular plate 112 which receive a respective one of a pair of opposed upstands 152 provided on the sidewall 142 of the spray target apparatus. Importantly, the cavity 148 is visible through an opening defined within the target apparatus sidewall 142. The configuration of the spray target apparatus is such that the spray target plate is displaced from the lower mounting bracket by a distance of approximately 60 mm The spray target plate 146 defines a spray impact surface for fluid to be injected which is denoted with a spray target pattern 161 in the form of a 'target'. When the injected fluid impinges on the spray target plate 146, a mark is formed on the impact surface to indicate the positioning of the fuel spray jet. The marking can then be inspected to deduce characteristics of the injector and assess quality and performance, for example, of the injector. Typically the spray target plate 146 takes the form of a foam pad which is received within the cavity 148.

The testing apparatus may be provided with an imaging means (not shown), typically in the form of a camera, which resides to one side of the spray target apparatus 30 and is configured to record an image through the opening in the target apparatus sidewall 142 and, hence, an image of the injected fluid spray. The apparatus may further include a display which is configured to show, on a first section of the display screen, an image to show a desired injected spray pattern. In a second section of the display screen, the screen has pass and fail buttons for the user to select pass of fail depending if spray pattern of the injector under test matches the desired pattern or not (assessed visually by the operator).

It is a benefit of the spray target apparatus 30 that both a side view of the injected fluid is available to the user of the testing apparatus, as well as an end view as determined from the spray marking on the spray target plate 146. This provides a much better indication of the characteristics of the injected spray than is previously possible using known testing equipment. Consequently, the requirement is removed for highly skilled service engineers to judge injected spray quality "by eye", and the testing method lends itself to operation by a wider range of service engineers.

Figure 11:
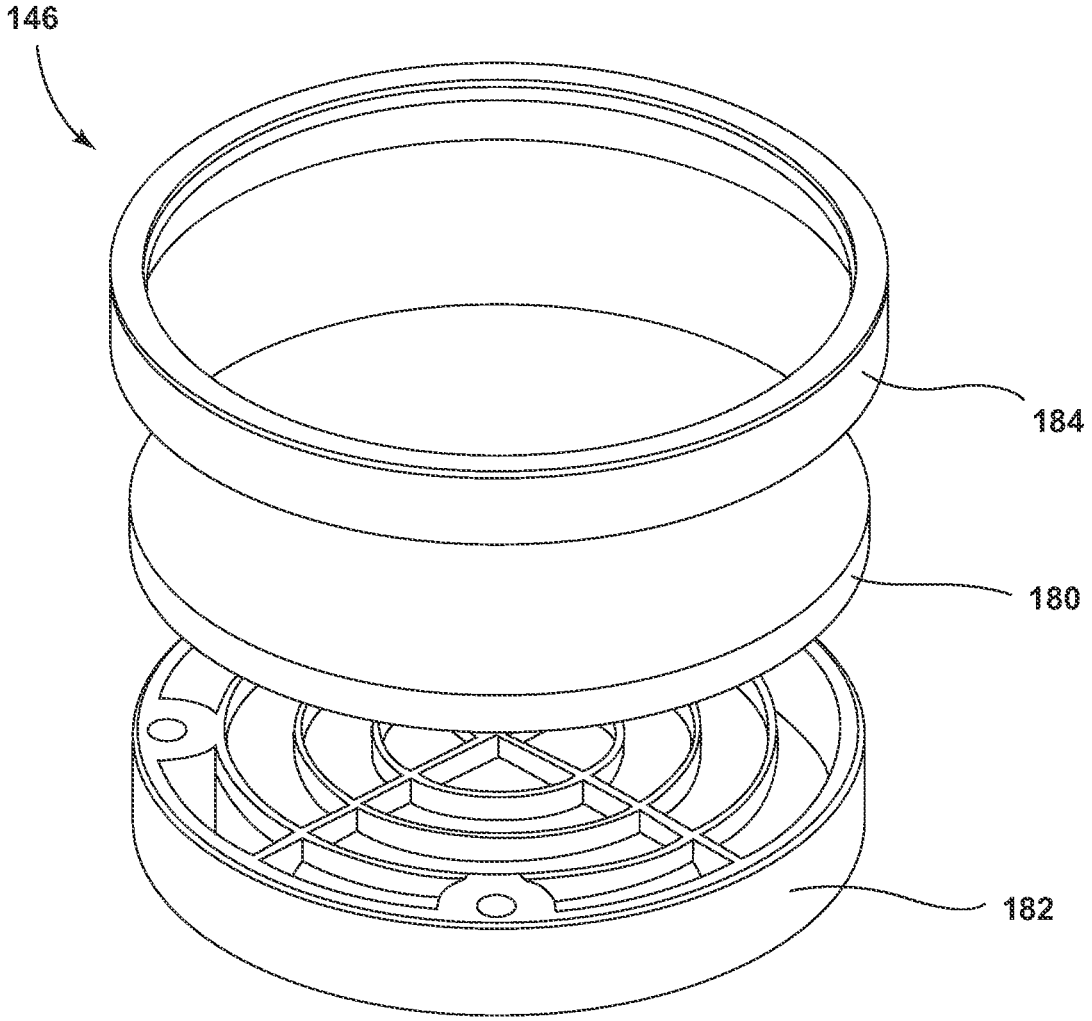
FIG. 11 is an exploded view of a spray target plate assembly which may form a part of the testing apparatus of previous Figures.
Figure 12:
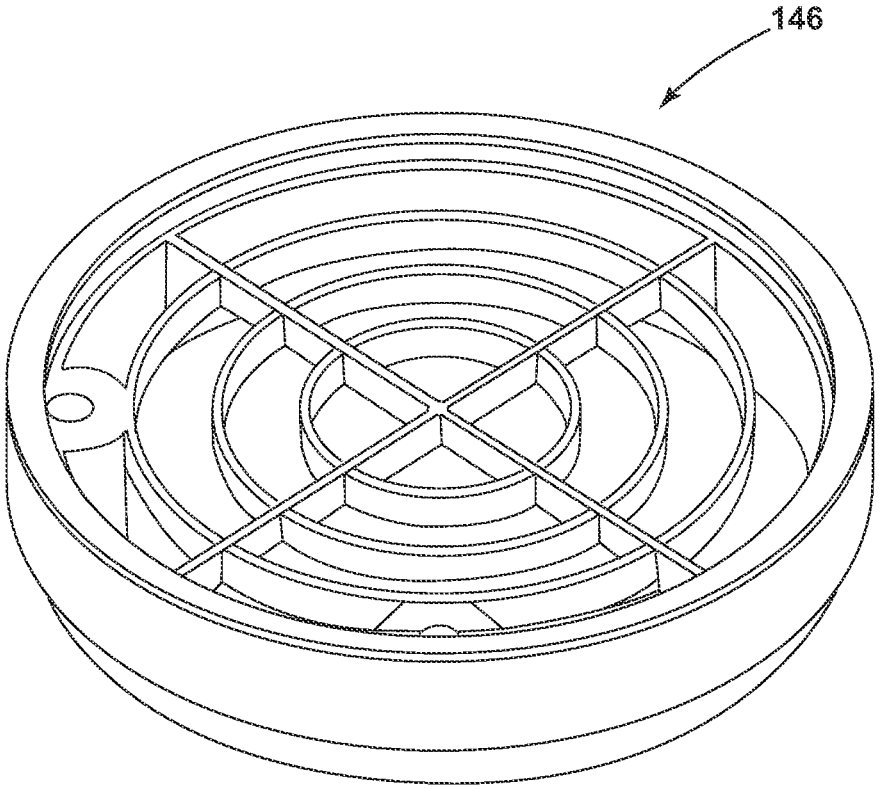
FIG. 12 is an example of a target spray pattern which may be denoted on the target plate of the assembly in FIG. 11.

Instead of using a foam pad for the spray target plate, in another embodiment, as shown in FIGS. 11 and 12, a spray target plate 146 may comprise multiple parts including a mesh screen 180 held in place over a target base 182 by means of an annular securing piece 184.

Another challenge in utilizing a testing apparatus to test a wide variety of different injectors is that a widely differing range of fluid pressure is required. For example, diesel injectors, in use, operate at supply pressure in excess of 2000 bar, or even in excess of 3000 bar, whereas gasoline injectors typically operate at supply pressures around 3-200 bar.

The different pressure requirements for diesel injectors compared to gasoline injectors means that the injectors must be tested under different conditions, namely at considerably higher fluid pressure for diesel injectors compared to gasoline injectors. This poses a problem because one flow measurement device being used to determine the flow characteristics of the fluid is not optimized for all injector types. This means means that a different flow measurement device must be used for the low pressure gasoline injectors, and this poses a problem as that different device does not give accurate readings when there are large pulsations in the flow.

Figure 13:
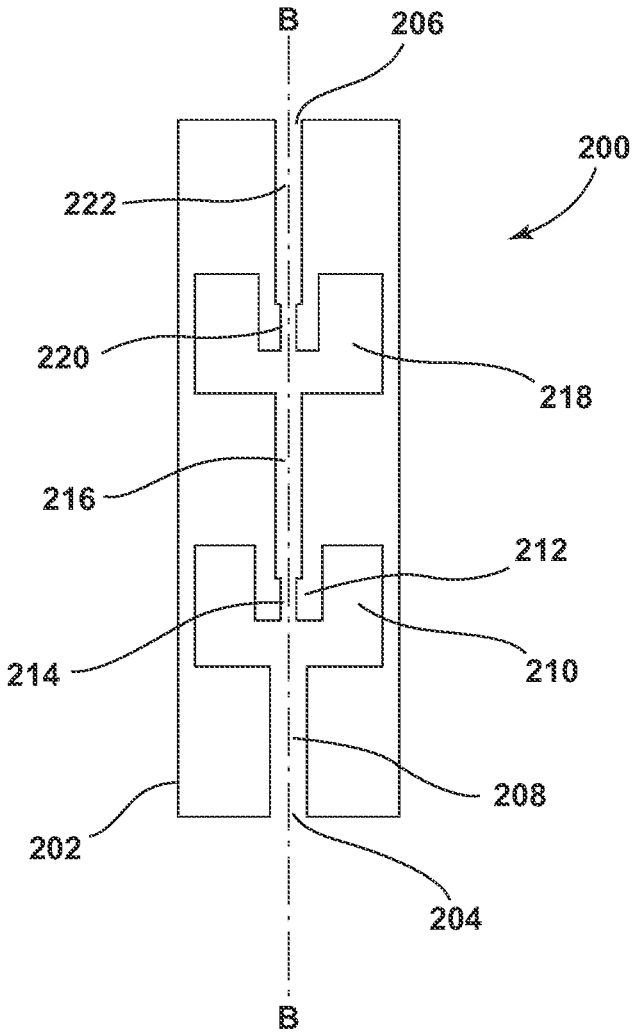
FIG. 13 is a schematic diagram of a damper device which may be included in the testing apparatus of previous figures.

In the present invention, and referring also to FIG. 13, the testing apparatus is fitted with a damper device 200 which serves to reduce the pressure fluctuations in the flow prior to it passing through the flow measurement device. Whilst it is known to use a damper with a flow measurement device, in the present invention the damper device has a novel configuration which provides a more economical way to ensure the flow measurement device can be used without compromising accuracy.

Referring to FIG. 13, the damper device 200 includes a housing 202 having an inlet port 204 and an outlet port 206, with the outlet port 206 being connected to the inlet 204 of the flow measurement device (not shown in FIG. 13). Fuel supplied to the inlet port 204 is delivered to an inlet passage 208 which opens into a first chamber 210 having a U-shaped cross section. The walls of the chamber 210, defined within the housing 202, are shaped so that the first chamber 210 defines an annular cavity having a uniform cross section around its full circumference. A first central region 212 of the housing defines an internal annular wall of the annular cavity 210.

A first restriction 214 is located within the central region 212 and provides an exit path from the chamber. The restriction 214 leads to a first outlet passage 216 which communicates, at the other end, with a second chamber 218 having a U-shaped cross section. The second chamber 218 is of the same configuration as the first chamber 210 and also has a second restriction 220 at the exit which delivers fluid to an outlet passage 222. The outlet passage 222 communicates with the outlet port 206 from the damper device 200.

Fluid that enters the inlet port 204 of the damper device, in use, therefore flows through the first and second chambers 210, 218, and the first and second restrictions 214, 220, and exits the damper device 200 through the outlet port 206. The first and second chambers and the various passages and restrictions, are aligned along a longitudinal axis B-B of the damper device so that the flow path for fluid through the device is linear along the longitudinal axis B-B.

In use, as fluid flows into the first chamber 210 it starts to fill up until the fluid level reaches the restriction 214. The position of the restriction 214 is important as it means that fluid encounters the restriction 214 rather than filling the cavity completely (i.e. the restriction is positioned beneath the upper end of the chamber), thereby ensuring a cavity remains which is filled with air and void of fluid. The region of the annular cavity 210 above the fluid level is therefore filled with air at atmospheric pressure and so any pressure pulses or fluctuations within the flowing fluid are to some extent absorbed, or damped, as they impinge on the air-filled cavity 210. The damping effect is repeated as fluid continues to flow through the damper device and through the second U-shaped chamber 218 which is arranged in series with the first U-shaped chamber 210.

Additional chambers may be provided in the device to enhance the damping effect still further.

Figure 14:
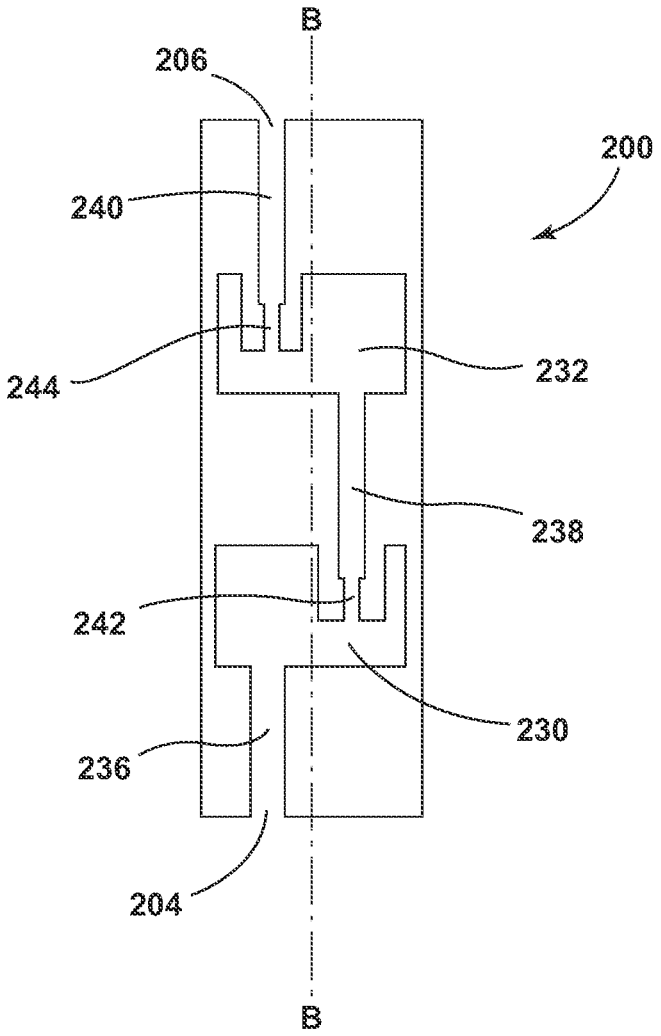
FIG. 14 is a schematic diagram of an alternative damper mechanism to that shown in FIG. 13.

Referring to FIG. 14, in an alternative embodiment of the damper device 200 the U-shaped chambers 230, 232 are shaped to include a relatively wide region and a relatively narrow region. The first and second U-shaped chambers 230, 232 are oriented so that one cavity has the relatively wide cavity region on one side of the device and the subsequent cavity has the relatively wide cavity region on the other side of the device. As before, fluid flowing into the first chamber 230 encounters the outlet restriction 242 rather than filling the cavity completely so that the cavity remains filled with air at atmospheric pressure. The same applies for the position of the outlet restriction 244 from the second chamber 232.

A further feature of the FIG. 14 embodiment is that the inlet and outlet passages 236, 238, 240 from each U-shaped chamber are staggered relative to one another and relative to the longitudinal axis B-B of the device 200, with the inlet passages 236, 238 entering the respective U-shaped chamber in the relatively wide section of the respective chamber 230, 232. The effect of this configuration is that the fluid path through the damper device is convoluted, rather than being linear as in FIG. 13. The convoluted fluid path in the FIG. 14 embodiment is thought to provide an enhanced damping efficiency, compared to the configuration in FIG. 13.

It will be appreciated that the U-shaped nature of the chambers of FIGS. 13 and 14 is not essential, only that the restriction 214, 220, 242, 244 at the outlet from each of the chambers is positioned to ensure fluid encounters the restriction before filling the chamber (i.e. the restriction at the exit port from the chamber lies beneath an upper region of the chamber), thereby leaving an air-filled cavity which serves to damp pressure fluctuations.

It will be appreciated that many modifications may be made to the above examples without departing from the scope of the present invention as defined in the accompanying claims.

The invention claimed is:

1. A testing apparatus for a fuel injector which delivers fuel into an internal combustion engine, wherein the fuel injector comprises an inlet for receiving fluid to be injected during a test and a nozzle end for delivering the fluid through an injector outlet during the test, the testing apparatus comprising:

an upper mount for receiving the inlet of the fuel injector;

a lower mount located beneath the upper mount for receiving the nozzle end of the fuel injector;

a fluid flow measurement device located downstream of the fuel injector under test and being connected to an outlet line from the fuel injector under test, wherein the fluid flow measurement device is provided with a damper device which limits fluctuations in fluid pressure of fluid flow within the outlet line;

wherein the damper device includes a damper inlet and a damper outlet and a chamber located in a flow path between the damper inlet and the damper outlet, and a restriction located at an exit port from the chamber, wherein the restriction is positioned such that fluid exits through the restriction rather than filling the chamber completely, thereby defining a cavity within the chamber which is filled with trapped air at atmospheric pressure which acts as a damping medium for fluid flowing through the damper device during injector testing; and at least one of:

1) An inlet adaptor for use with the fuel injector which is a first type, wherein the inlet end of the fuel injector of the first type fits into the inlet adaptor to allow a flow of fluid to be delivered through the inlet adaptor to the fuel injector of the first type, the inlet adaptor being removable from the upper mount when a fuel injector of a second type is tested, or being interchangeable with a different inlet adaptor when the fuel injector of the second type is tested; and 2) An outlet adaptor for use with the fuel injector of the first type, and being removable from the lower mount when the fuel injector of the second type is tested or being interchangeable with a different outlet adaptor when the fuel injector of the second type is tested.

2. The testing apparatus as claimed in claim 1, wherein the inlet adaptor comprises an inlet port having an adaptor screw thread which connects with a primary screw thread on an outlet port of a fluid supply apparatus to the testing apparatus.

3. The testing apparatus as claimed in claim 1, wherein the outlet adaptor is included in the testing apparatus when the nozzle end of the fuel injector of the first type has a relatively small diameter and is removable or is interchangeable with the different outlet adaptor when a nozzle end of the fuel injector of the second type has a relatively large diameter.

4. The testing apparatus as claimed in claim 1 further comprising a support structure which mounts the upper mount onto the lower mount, wherein the fuel injector under test extends through the support structure when received in the testing apparatus.

5. The testing apparatus as claimed in claim 1, wherein the fuel injector of the first type is a gasoline injector and the fuel injector of the second type is a diesel injector.

6. A method of testing an injector using a testing apparatus as claimed in claim 1, the method comprising:

mounting the inlet adaptor in the upper mount when the fuel injector under test is of the first type, the inlet adaptor being removed from the upper mount when the fuel injector under test is of the second type or being interchanged with the different inlet adaptor when the fuel injector under test is of the second type; and mounting the outlet adaptor within the lower mount when the fuel injector under test is of the first type, the outlet adaptor being removed when the fuel injector under test is of the second type or being interchanged with the different outlet adaptor when the fuel injector under test is of the second type.

7. The testing apparatus as claimed in claim 1 further comprising a removable delivery chamber located beneath the lower mount for receiving injected fluid from the fuel injector under test in a first test mode.

8. The testing apparatus as claimed in claim 7 further comprising a clamp arrangement which cooperates with the lower mount and clamps the delivery chamber and the lower mount together.

9. The testing apparatus as claimed in claim 8 further comprising a removable target assembly having a target plate comprising a fluid spray impact surface which is impinged by fluid injected by the fuel injector under test during testing in a second test mode.

10. The testing apparatus as claimed in claim 9, wherein the target plate includes a spray target pattern denoted on the fluid spray impact surface.

11. The testing apparatus as claimed in claim 9 further comprising a housing for the target plate, wherein the housing mounts onto the lower mount and defines at least one opening in a sidewall of the housing so as to permit visual inspection of the injected fluid spray from the fuel injector under test.

12. The testing apparatus as claimed in claim 1 wherein said chamber is one of a plurality of chambers in series between the damper inlet and the damper outlet.

13. The testing apparatus as claimed in claim 12, wherein each of said plurality of chambers is of uniform cross section around an annular circumference thereof.

14. The testing apparatus as claimed in claim 12, wherein the flow path through the damper device is linear.

15. The testing apparatus as claimed in claim 12, wherein each of said plurality of chambers is of non-uniform cross-section around an annular circumference thereof so as to define a region of relatively great volume on one side of the damper device and a region of relatively smaller volume on the other side of the damper device.

16. The testing apparatus as claimed in claim 12, wherein the flow path through the damper device is not linear.

* * * * *